US006719387B2

(12) United States Patent
Rahman et al.

(10) Patent No.: US 6,719,387 B2
(45) Date of Patent: Apr. 13, 2004

(54) METHOD FOR REDUCING TURN-OFF PROPAGATION DELAY IN PRINT HEAD DRIVERS

(75) Inventors: Md Abidur Rahman, Allen, TX (US); Brett E. Smith, McKinney, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/200,718

(22) Filed: Jul. 22, 2002

(65) Prior Publication Data

US 2004/0012646 A1 Jan. 22, 2004

(51) Int. Cl.[7] ..... B41J 29/38
(52) U.S. Cl. ..... 347/5; 327/389
(58) Field of Search ..... 347/5, 9; 326/95, 326/98; 327/389, 390, 391, 392, 394, 395, 396, 399, 400, 401, 404, 408, 409, 410, 576, 581

(56) References Cited

U.S. PATENT DOCUMENTS 3,959,782 A * 5/1976 Dunn ..... 365/149

OTHER PUBLICATIONS

Theodore F. Bogart, Jr., Electronic Devices and Circuits, 1986, Merrill Publishing Company, pp. 292–296.*

* cited by examiner

*Primary Examiner*—Stephen D. Meier
*Assistant Examiner*—Blaise Mouttet
(74) *Attorney, Agent, or Firm*—J. Dennis Moore; W. James Brady, III; Frederick J. Telecky, Jr.

(57) ABSTRACT

An improved inkjet print head driver. The driver includes a source of predrive charge for a first, drive transistor coupled by its source and drain between an output node and a power supply, and having its gate coupled to the source of predrive charge. A second transistor is provided, adapted to receive an input signal at its gate. A third, control transistor is coupled by its source and drain between the gate of the first transistor and the second transistor, the second transistor being coupled by its source and drain between the third transistor and ground. Optionally, a resistor is coupled in parallel with the third transistor, i.e., across the source and drain of the third transistor.

2 Claims, 1 Drawing Sheet

METHOD FOR REDUCING TURN-OFF PROPAGATION DELAY IN PRINT HEAD DRIVERS

TECHNICAL FIELD OF THE INVENTION

This invention relates to driver circuits for inkjet printers, and more particularly relates to a method for controlling propagation delay in inkjet print head drivers.

BACKGROUND OF THE INVENTION

Inkjet printers are common adjuncts to personal computers. Such printers operate by placing extremely small droplets of ink (typically between 50 and 60 microns in diameter) onto paper to create an image. The placement of these droplets is very precise, allowing resolutions of up to 1440×720 dots per inch. The unit of the inkjet printer that actually delivers the droplets of ink to the paper is the print head assembly, which includes the print head, one or more ink cartridges, the print head stepper motor, a belt and a stabilizer bar. The stepper motor moves the print head assembly back and forth across the paper, with the stabilizer bar ensuring precise and controlled movement of the print head. The belt attaches the print head to the stepper motor. The ink cartridges serve as portable containers for the ink, and typically attach to the print head in a manner allowing for their easy replacement when the ink is spent.

The print head is the component that actually delivers the droplets of ink. It includes a series of nozzles that are used to spray the droplets of ink. The most widely used technologies to form the droplets are thermal bubble and piezo-electric.

In thermal bubble technology, ink is directed from the cartridge to a small reservoir at the location of a nozzle. Tiny resistors in contact with the small reservoir have an electrical pulse applied to them, causing them to rapidly create heat. This heat vaporizes some of the ink in the reservoir, creating a bubble. The expanding bubble pushes some of the ink out of the nozzle onto the paper. The heat is only generated for a small interval, sufficient to create the proper size droplet and propel it out of the nozzle to the paper. When the resistor cools, the bubble collapses and a vacuum is created, drawing more ink into the small reservoir for the next cycle.

In piezo-electric technology, as with thermal bubble technology, ink is directed from the cartridge to a small reservoir at the location of a nozzle. However, a piezo-electric crystal is located at the back of the ink reservoir, opposite the nozzle. The crystal receives an electrical pulse that causes it to vibrate. When the crystal vibrates into the reservoir, it pushes some of the ink out of the nozzle onto the paper. When it vibrates back out of the reservoir, it draws in more ink for the next cycle.

Both of these technologies require that the electrical pulse be generated in a controlled manner, such that the pulse has minimal propagation delay, but with carefully controlled timing. To this end, the integrated circuits including the electrical drivers that generate these electrical pulses have included expedients to accomplish this control. Such expedients include 1) quickly discharging the gate of the output driver transistor through a clamp to ground, and then slewing the discharge, 2) quickly and temporarily discharging the gate of the output driver transistor to its source, 3) providing a floating gate drive, 4) quickly discharging the gate of the output driver transistor to its drain, prior to slewing off.

The first of these approaches is shown in FIG. 1, in which a predrive circuit 12 charges the gate of NMOS transistor $M_1$ at turn-on. At turn-off, diode D1 provides a low impedance path to quickly pull the gate of $M_1$ down to reduce turn-off propagation delay. The gate of $M_1$ is then discharged to ground through resistor $R_S$, thus controlling the fall time. However, this approach does not work well with a varying $V_{DD}$.

The second of these approaches is shown in FIG. 2, in which, again, predrive circuit 12 charges the gate of NMOS transistor $M_1$ at turn-on. At turn-off, one shot 14 is activated for the time period of the one shot when input IN goes high, thus closing relay 16 and discharging the gate of transistor $M_1$ to its source for that time period. The fall time is then controlled by slewing the gate to ground through resistor $R_S$. However, this approach requires more chip area to implement, as does the fourth approach listed above. The third approach makes the fall time solely controlled by the load.

SUMMARY OF THE INVENTION

It would therefore be desirable to have an inkjet print head driver providing minimal propagation delay, while providing controlled rise and fall time, but without the problems described above. The present invention provides such a print head driver. In accordance with the present invention there is provided an improved inkjet print head driver. The driver includes a source of predrive charge for a first, drive transistor coupled by its source and drain between an output node and a power supply, and having its gate coupled to the source of predrive charge. A second transistor is provided, adapted to receive in input signal at its gate. A third, control transistor is coupled by its source and drain between the gate of the first transistor and the second transistor, the second transistor being coupled by its source and drain between the third transistor and ground.

These and other features of the invention will be apparent to those skilled in the art from the following detailed description of the invention, taken together with the accompanying drawings.

DETAILED DESCRIPTION OF THE PREFERRED EMBODIMENT

The numerous innovative teachings of the present invention will be described with particular reference to its presently preferred exemplary embodiment. However, it should be understood that this embodiment provides only one example of the advantageous uses and innovative teachings herein. In general, statements made in the specification of the present application do not necessarily delimit the invention, as set forth in different aspects in the various claims appended hereto. Moreover, some statements may apply to some inventive aspects, but not to others.

Figure 1:
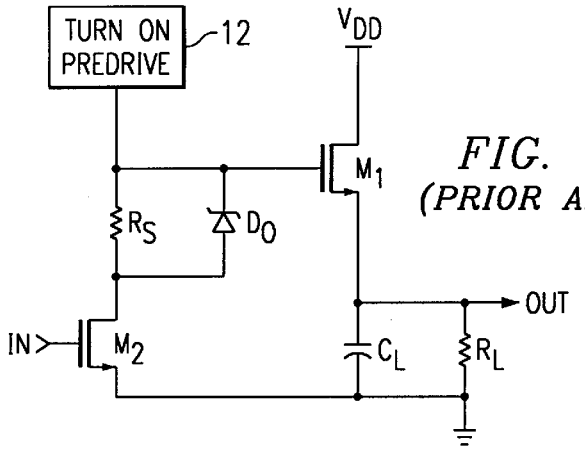
FIG. 1 (PRIOR ART)
FIG. 1 is a circuit diagram of a first prior art inkjet print head driver.
Figure 2:
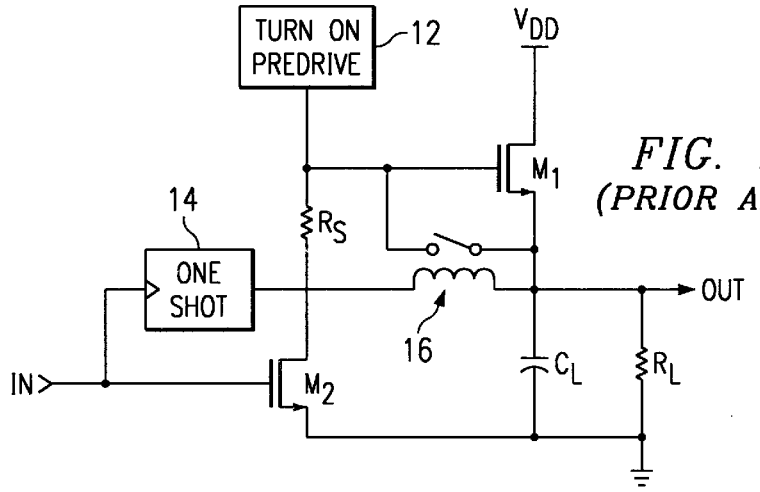
FIG. 2 (PRIOR ART)
FIG. 2 is a circuit diagram of a second prior art inkjet print head driver.
Figure 3:
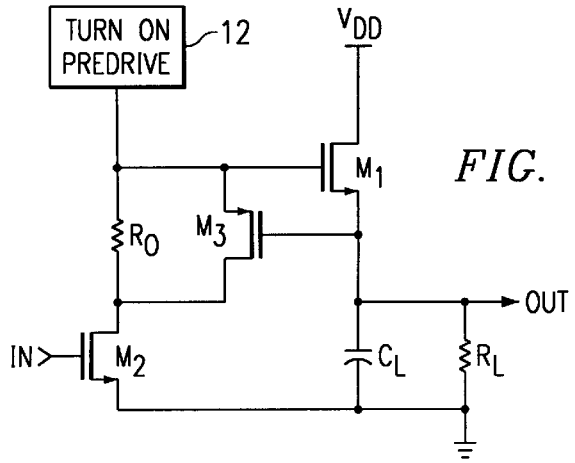
FIG. 3 is a circuit diagram of the preferred embodiment of the inkjet print head driver of the present invention.

FIG. 3 is a circuit diagram of the preferred embodiment of the present invention. A predrive circuit 12 is provided for charging the gate of an NMOS drive transistor $M_1$, which has its drain connected to a power supply VDD. The source of transistor $M_1$ is connected to the driver circuit output OUT, which has a load including a capacitive component $C_L$ and a resistive component $R_L$. Also connected to the gate of transistor $M_1$ is one port of a resistor $R_O$, which is optional in this circuit, and the source of a PMOS transistor $M_3$. The gate of transistor is connected to the circuit output OUT, and the drain of transistor $M_3$ is connected to the other port of resistor $R_O$. The common connection node of the drain of transistor $M_3$ and resistor $R_O$ is connected the drain of an NMOS transistor $M_2$, which has its source connected to ground, with its gate receiving the input signal IN.

In operation, transistor $M_3$ provides a low impedance path during the initial part of the turn-off transition so as to reduce the propagation delay of the transition from high to low. However, as the saturation region of transistor $M_3$ is entered, the impedance of transistor $M_3$ increases, thus controlling the fall time. As mentioned above, resistor $R_O$ is optional, adding flexibility to independently speed up fall time.

What is claimed is:

1. An inkjet print head driver, comprising:

a power supply node for receiving power from a power supply;

a predrive circuit for providing a predrive charge;

a first, drive transistor coupled by its source and drain between an output node and the power supply node, and having its gate coupled to said predrive circuit;

a second transistor adapted to receive an input signal at its gate; and a third, control transistor coupled by its source and drain between the gate of the first transistor and the second transistor, and having its gate coupled to the output node, the second transistor being coupled by its source and drain between the third transistor and ground.

2. An inkjet print head driver according to claim 1, further comprising a resistor coupled in parallel with said third transistor, being coupled across the source and drain of said third transistor.

* * * * *